US006735849B2

(12) United States Patent
Cheng et al.

(10) Patent No.: US 6,735,849 B2
(45) Date of Patent: May 18, 2004

(54) METHOD OF MAKING DUAL BAND MICROSTRIP ANTENNA

(75) Inventors: Yung Chang Cheng, Tu-Chen (TW); Hsin Kuo Dai, Tu-Chen (TW)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 44 days.

(21) Appl. No.: 10/033,264

(22) Filed: Dec. 26, 2001

(65) Prior Publication Data

US 2003/0101571 A1 Jun. 5, 2003

(51) Int. Cl.[7] ..... H01P 11/00; H01Q 13/00

(52) U.S. Cl. ..... 29/600; 29/831; 29/840; 343/700 MS; 343/762

(58) Field of Search ..... 29/600, 831, 840; 343/700 MS, 762, 702

(56) References Cited

U.S. PATENT DOCUMENTS 6,114,996 A * 9/2000 Nghiem ..... 343/700 MS
6,313,798 B1 * 11/2001 Bancroft et al. ..... 343/700 MS
2002/0180643 A1 * 12/2002 Skladany et al. .... 343/700 MS

* cited by examiner

*Primary Examiner*—Carl J. Arbes
*Assistant Examiner*—Tim Phan
(74) *Attorney, Agent, or Firm*—Wei Te Chung

(57) ABSTRACT

A dual band microstrip antenna (1) made by a method of the present invention includes a dielectric substrate (11), a ground plane layer (10) attached to a bottom surface (111) of the substrate, a first and second conductive patches (21, 22) separately elevated above and parallel to a top surface (110) of the substrate, a first and second conductive posts (23, 24) electrically connecting the first and second conductive patches respectively with the ground plane layer and a first and second coaxial feeder cables (25, 26). A method for making the dual band microstrip antenna includes adjusting the height of the first and second conductive posts to achieve a good performance of the dual band microstrip antenna.

7 Claims, 8 Drawing Sheets

| Gain \ Frequency | 2.4GHZ | 2.45GHZ | 2.5GHZ |
|---|---|---|---|
| Max Gain(dBi) | 6.08 | 6.58 | 6.01 |
| AVG Gain(dBi) | 1.514 | 1.986 | 1.339 |

| Gain \ Frequency | 5.15GHZ | 5.25GHZ | 5.35GHZ |
|---|---|---|---|
| Max Gain(dBi) | 4.82 | 4.41 | 4.66 |
| AVG Gain(dBi) | -0.99 | -1.528 | -1.286 |

METHOD OF MAKING DUAL BAND MICROSTRIP ANTENNA

FIELD OF THE INVENTION

The present invention relates to a method of making an antenna, and in particular to a method of making a dual band microstrip antenna.

BACKGROUND OF THE INVENTION

Referring to FIG. 1, a conventional microstrip antenna comprises an insulative substrate 20', a conductive patch 21' attached to one surface of the substrate and a ground plane layer 22' attached to another, opposite surface of the substrate. RF signals are fed to the antenna by a coaxial cable or a conductive strip 23'. Electrical and magnetic fields are formed between the patch and the ground plane layer and electromagnetic wave radiate from gaps between and around the patch and the ground plane layer.

Parameters of the elements of the microstrip antenna will affect operating performance of the microstrip antenna. To achieve desirable performance through selecting, calculating and testing parameters of the elements, a method for making a microstrip antenna generally comprises the following steps:

1. selecting the thickness t and the relative dielectric constant $\epsilon_r$ of the insulative substrate;
2. selecting the width W of the conductive patch 21' using the equation $$W=(\lambda/2)[2/(\epsilon_r+1)]^{1/2}$$

where $\lambda$=c/f, and where $\lambda$ and f are respectively the wavelength and frequency of the operating signals, and c is the speed of light in a vacuum;

3. calculating the effective length L and the effective dielectric constant $\lambda_e$ of the conductive patch 21' using the equation $$L=\lambda/2\epsilon_e^{1/2}-2\Delta L, \text{ where}$$

$$\Delta L=(0.412t)(\epsilon_e+0.3)(W/t+0.264)/(\epsilon_e-0.258)(W/t+0.8) \text{ and}$$

$$\epsilon_e=(\epsilon_r+1)/2+[(\epsilon_r-1)/2](1+12t/W)^{-1/2}, \text{ where}$$

$\Delta$L is the effective extending length of the conductive patch;

4. selecting a feed point location on the patch;
5. measuring the radiation pattern and Voltage Standing Wave Ratios (VSWR) of the microstrip antenna; and
6. if the measured results do not satisfy operating requirement, returning to the first step and repeating all steps until a satisfactory result is achieved.

A conventional dual band microstrip antenna is disclosed in U.S. Pat. No. 5,561,435. Referring to FIG. 2, the dual band microstrip antenna comprises a first, second and third superimposed dielectric layers 4', 6', 16', a ground plane 2' on one external surface, a conductive patch 18' on an opposite external surface, and parallel conductive strips 12', 14' at the interface of the dielectric layers 6', 16', closer to the patch 18' than to the ground plane 2'. The dielectric constant of the second layer 6' is different from that of the first and third layers 4', 16'. As disclosed above, the performance of the dual band microstrip antenna can be optimized by adjusting the thickness and the dielectric constants of the dielectric layers 4', 6', 16'.

However, the dielectric constant is related to the material of the layer, so adjusting the dielectric constant implies changing the material of the layer and it is difficult to get an exact value of dielectric constant in this way. Furthermore, a minimum value of the dielectric constant is close to but is no less than 1 (as is air), and the thickness t of the dielectric layer generally should be far less than $\lambda$ for considerations of size, so adjusting the performance of the microstrip antenna by varying thickness and dielectric constant is realistically very limited. Each value of thickness and dielectric constant of each of the dielectric layers 4', 6', 16' will affect the whole performance of the antenna in two operating frequency bands at the same time.

Hence, an improved method of making a dual band microstrip antenna is desired to overcome the above-mentioned shortcomings of the existing method.

BRIEF SUMMARY OF THE INVENTION

A primary object, therefore, of the present invention is to provide an improved method of making a dual band microstrip antenna which allows adjusting the performance of the antenna individually and conveniently in each operating frequency band.

Another object is to provide a method of making a dual band microstrip antenna, which allows adjusting the performance of the antenna in a wider range.

A dual band microstrip antenna made by a method in accordance with the present invention comprises a dielectric substrate, a ground plane layer attached to a bottom surface of the substrate, a first and second conductive patches separately elevated above and parallel to a top surface of the substrate, a first and second conductive posts respectively elevating the first and second radiating patches above the substrate and electrically connecting the first and second patches with the ground plane layer, and a first and second coaxial feeder cables. The method for making the dual band microstrip antenna comprises adjusting the height of the first and second conductive posts to achieve a good performance of the dual band microstrip antenna.

Other objects, advantages and novel features of the invention will become more apparent from the following detailed description of a preferred embodiment when taken in conjunction with the accompanying drawings. The copending application with the same applicant and the same assignee as the invention, titled "DUAL BEND MICROSTRIP ANTENNA" filed on the same date with the invention is referenced hereto.

DETAILED DESCRIPTION OF THE INVENTION

Figure 1:
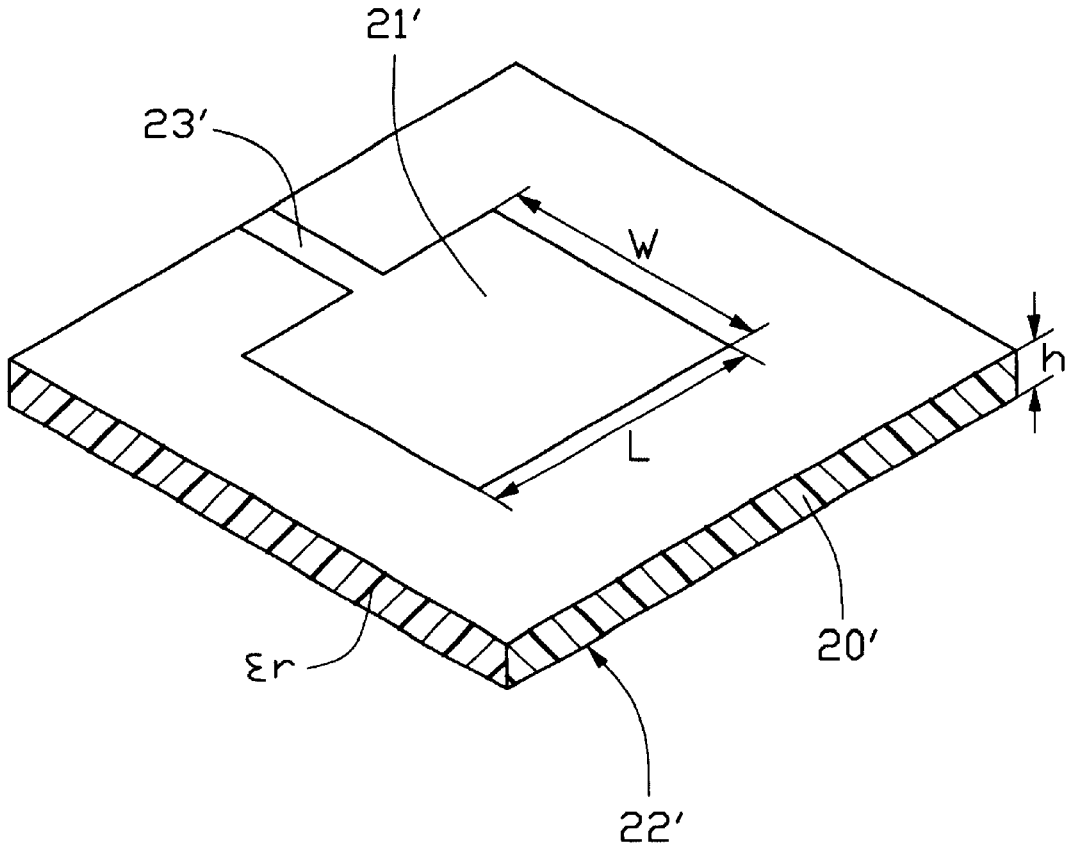
FIG. 1 (PRIOR ART)
FIG. 1 shows a conventional microstrip antenna.
Figure 2:
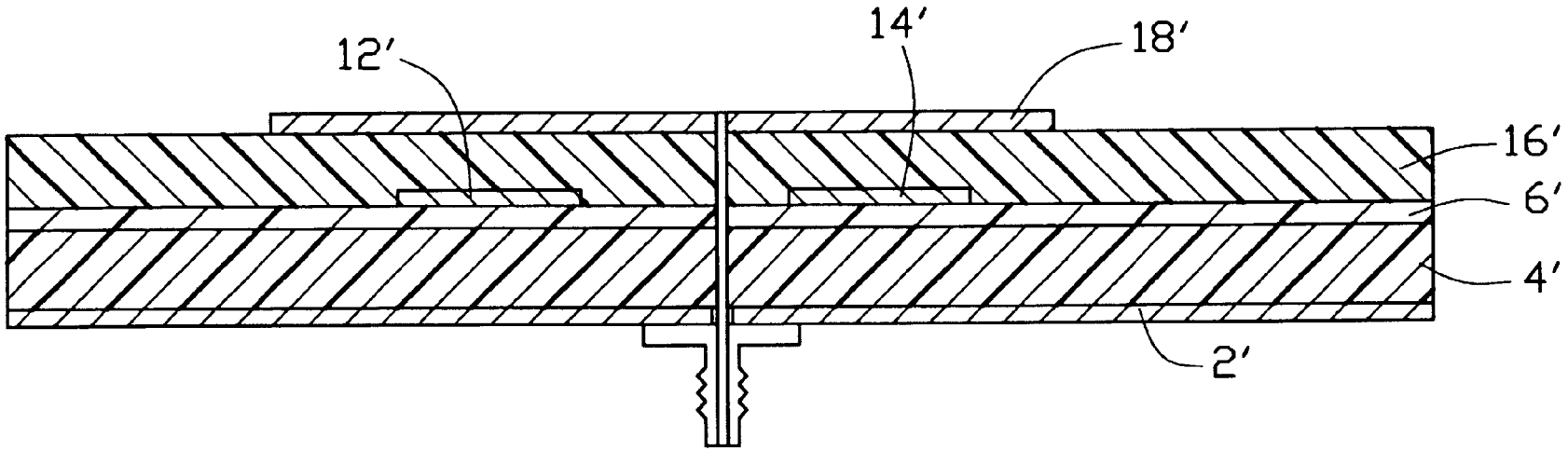
FIG. 2 (PRIOR ART)
FIG. 2 is a cross-sectional view of a conventional dual band microstrip antenna.
Figure 3:
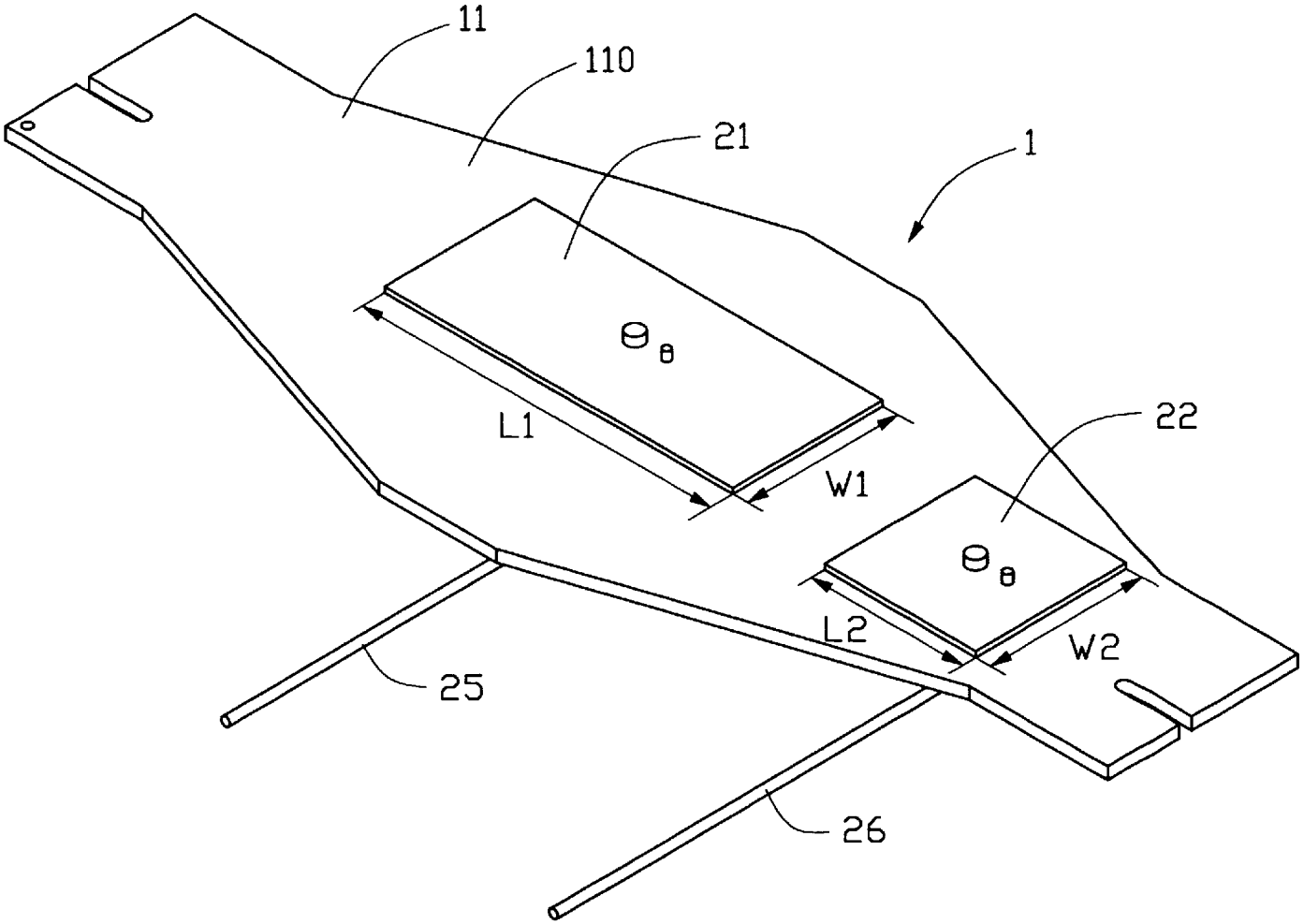
FIG. 3 is a perspective view of a dual band microstrip antenna in accordance with the present invention.
Figure 4:
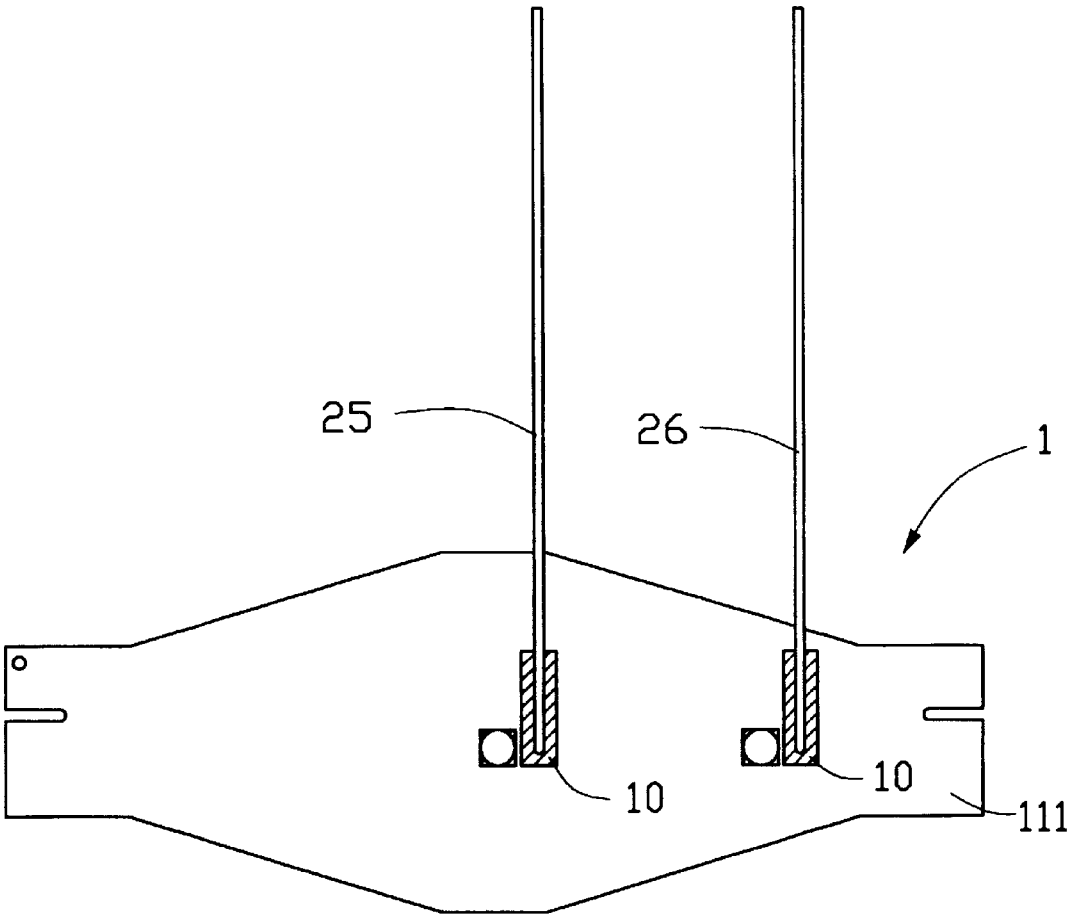
FIG. 4 is a bottom view of the dual band microstrip antenna of FIG. 3.

Reference will now be made in detail to a preferred embodiment of the present invention.

Referring to FIGS. 3–6, a dual band microstrip antenna 1 in accordance with the present invention comprises a dielectric substrate 11, a first and second conductive patches 21, 22, a first and second conductive posts 23, 24, a ground plane layer 10 and a first and second coaxial feeder cables 25, 26.

The first and second conductive patches 21, 22 are each separately elevated appropriate distances above a top surface 110 of the dielectric substrate 11, respectively by the first and second conductive posts 23, 24. Each of the first and second conductive patches 21, 22 is parallel to the top surface 110. The ground plane layer 10 is attached to a bottom surface 111 of the dielectric substrate 11. The first and second conductive posts 23, 24 electrically connect the first and second conductive patches 21, 22 with the ground plane layer 10, respectively. The first coaxial feeder cable 25 comprises a first conductive braiding layer 251 soldered to the ground plane layer 10 and a first conductive inner core 250 passing through the dielectric substrate 11 and soldered to the first conductive patch 21. The second coaxial feeder cable 26 comprises a second conductive braiding layer 261 soldered to the ground plane layer 10 and a second conductive inner core 260 passing through the dielectric substrate 11 and soldered to the second conductive patch 22.

Figure 5:
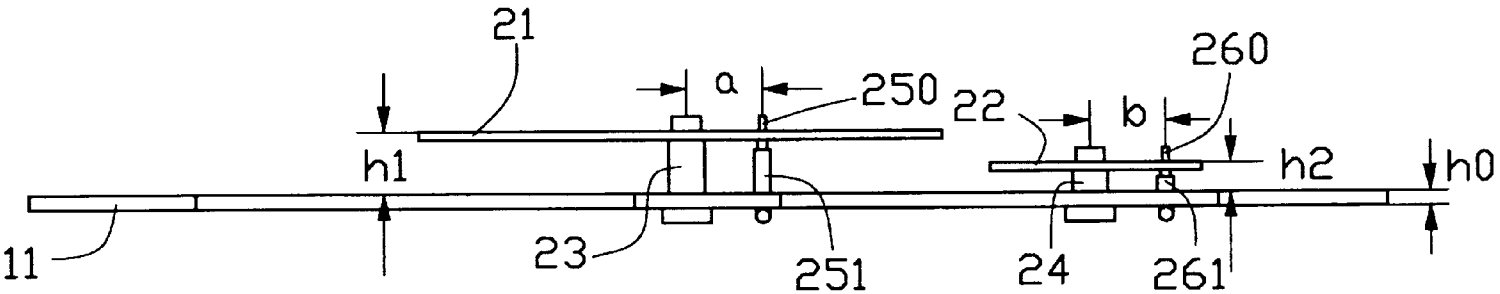
FIG. 5 is a front view of the dual band microstrip antenna of FIG. 3.
Figure 6:
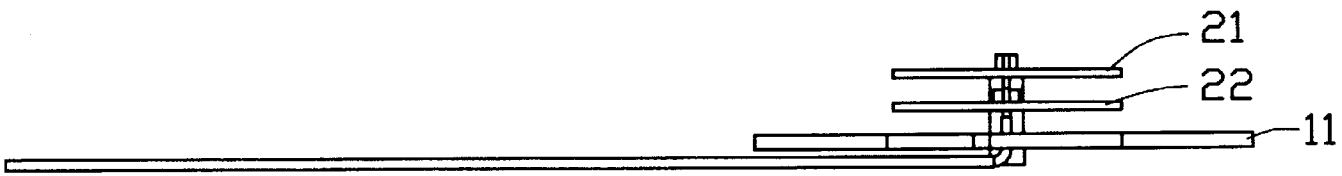
FIG. 6 is a side view of the dual band microstrip antenna of FIG. 3.
Figure 7:
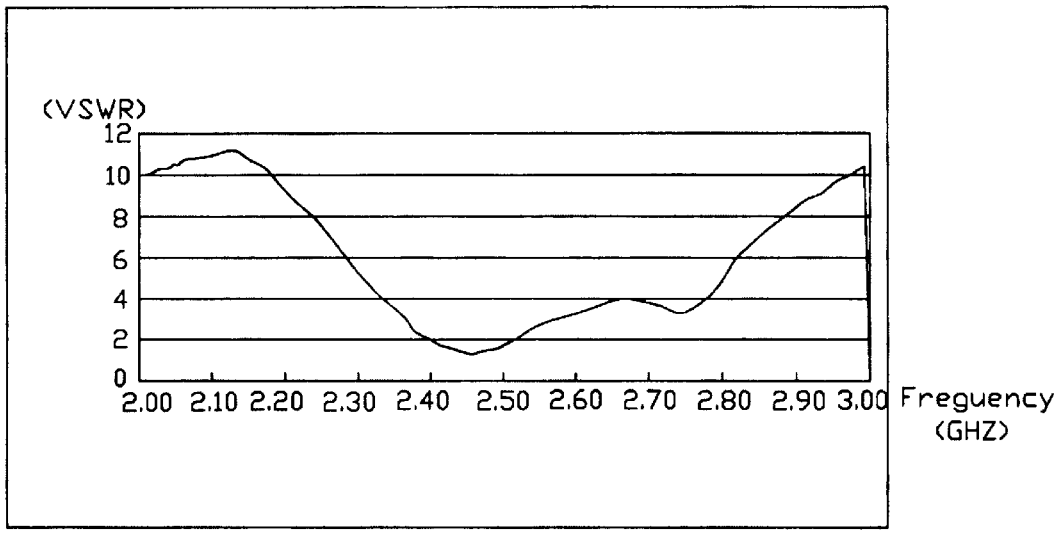
FIG. 7 is a test chart recording for the dual band microstrip antenna of FIG. 3 showing Voltage Standing Wave Ratio (VSWR) varying with frequency, particularly around 2.4 GHz.
Figure 8:
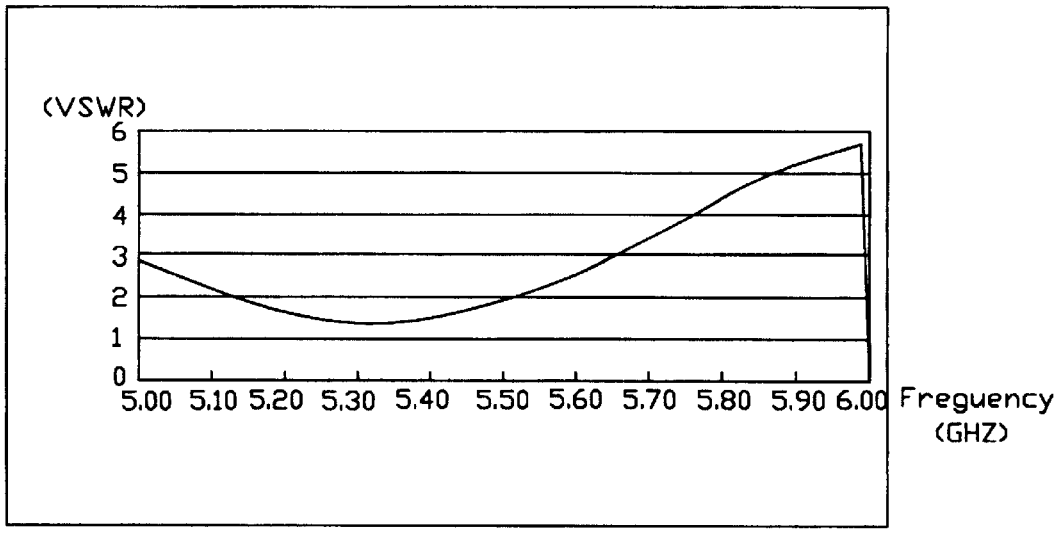
FIG. 8 is a second test chart recording for the dual band microstrip antenna of FIG. 3 showing Voltage Standing Wave Ratio (VSWR) varying with frequency, particularly around 5.2 GHz.
Figure 9:
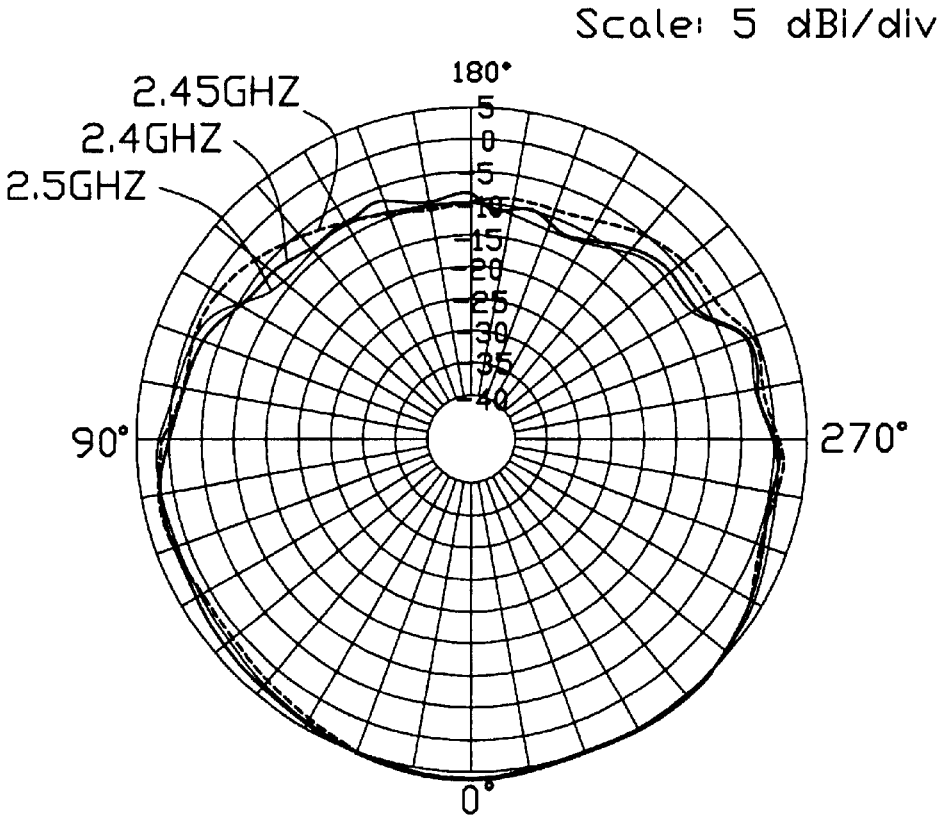
FIG. 9 is an illustration of radiation patterns of the dual band microstrip antenna of FIG. 3 respectively operating at frequencies of 2.4 GHz, 2.45 GHz and 2.5 GHz.
Figure 10:
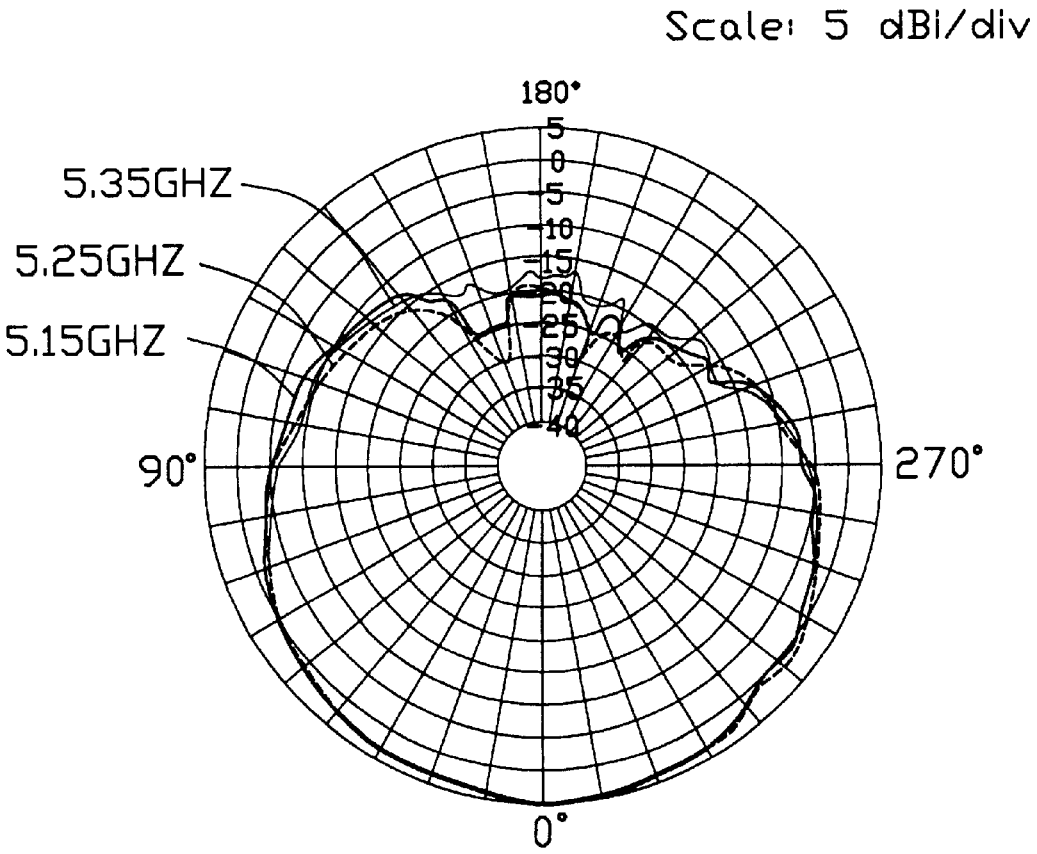
FIG. 10 is an illustration of radiation patterns of the dual band microstrip antenna of FIG. 3 respectively operating at frequencies of 5.15 GHz, 5.25 GHz and 5.35 GHz.

Particularly referring to FIG. 5, the matching impedance between the first conductive patch 21 and the first coaxial feeder cable 25 can be achieved by adjusting a distance "a" between the soldering position of the first conductive inner core 250 and the first conductive post 23 on the first conductive patch 21. The matching impedance between the second conductive patch 22 and the second coaxial feeder cable 26 can be achieved by adjusting a distance "b" between the soldering positions of the second conductive inner core 260 and the second conductive post 24 on the second conductive patch 22. The first and second conductive patches 21, 22 respectively operate in low and high frequency bands.

A method for making the dual band microstrip antenna 1 comprises the following steps:

1. selecting a thickness h (see FIG. 5) and a relative dielectric constant $\epsilon_r$ of the dielectric substrate 11, and the heights $h_1$ and $h_2$ of the first and second conductive patches 21, 22 above the top surface 110 of the dielectric substrate 11;
2. selecting the widths $W_1$ and $W_2$ of the first and second conductive patches 21, 22 using the equations $$W=(\lambda/2)[2/(\epsilon_r+1)]^{1/2} \text{ and}$$

$$\lambda=c/f, \text{ where}$$

$\lambda$ and f respectively are the wavelength and frequency of the intended operating signals, W is $W_1$ or $W_2$ and c is the speed of light in a vacuum;

3. calculating the effective lengths $L_1$ and $L_2$ and the effective dielectric constant $\epsilon_{e1}$ and $\epsilon_{e2}$ of the first and second conductive patches 21, 22 using the equations $L=\lambda/2\ \epsilon_e^{1/2}-2\ \Delta\ L$, $\Delta L=(0.412h)(\epsilon_{e+}0.3)(W/h+0.264)/(\epsilon_e 0.258)(W/h+0.8)$ and $\epsilon_e=(\epsilon_r+1)/2+[(\epsilon_r-1)/2](1+12h/W)^{-1/2}$, where $\Delta$ L is the effective extending length of the first conductive patch 21 or the second conductive patch 22, L is $L_1$ or $L_2$ and h is $h_0+h_1$ or $h_0+h_2$;
4. selecting feed point locations of the first and second coaxial feeder cables 25, 26 respectively on the first and second conductive patches 21, 22;
5. measuring radiation patterns and Voltage Standing Wave Ratios (VSWR) of the dual band microstrip antenna; and
6. if the measurement results do not satisfy operating requirements, changing the height $h_1$ or $h_2$, and repeating from the second step until a satisfactory result is achieved.

In this embodiment, both $h_0$ and $\epsilon_r$ are constant, wherein $h_0$=1.6 mm and $\epsilon_r$=4.5, and it is much more convenient to change the heights $h_1$ and $h_2$ to achieve a better performance of the dual band microstrip antenna 1, rather than to change $h_0$ and $\epsilon_r$. Actual testing results of a dual band microstrip antenna 1 are shown in FIGS. 7–10. It is noted that the structure of the two parts of the dual band microstrip antenna 1 that operate in two different frequency bands are similar but distinct from one another to each other, so just changing one of $h_1$ and $h_2$ will affect only the performance of the dual band microstrip antenna 1 in a single frequency band.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for making a dual band microstrip antenna, wherein the dual band microstrip antenna comprises a dielectric substrate, a ground plane layer attached to a bottom surface of the substrate, a first and second conductive patches separately elevated above and parallel to a top surface of the substrate, a first and second conductive posts electrically connecting the first and second conductive patches respectively with the ground plane layer and a first and second coaxial feeder cables, comprising the following steps:

selecting a thickness h0 and a relative dielectric constant $\epsilon$ r of the dielectric substrate, and a height h1 and h2 of the first and second conductive patches above the top surface of the substrate;

selecting a width W1 and W2 of the first and second conductive patches;

calculating an effective length L1 and L2 of the first and second conductive patches;

selecting feed point locations of the first and second coaxial feeder cables respectively on the first and second conductive patches;

measuring radiation patterns and Voltage Standing Wave Ratios (VSWR) of the dual band microstrip antenna; and if the testing result cannot satisfy operating requirements, changing the heights h1 or h2 and repeating from the second step until a satisfactory result is achieved.

2. The method as claimed in claim 1, wherein both h0 and $\epsilon$ r are constant and predetermined.

3. A method for making a microstrip antenna, wherein the microstrip antenna comprises a dielectric substrate, a ground plane layer attached to a bottom surface of the substrate, a conductive patch elevated above a top surface of the substrate, a conductive post electrically connecting the conductive patch with the ground plane layer and a coaxial feeder cable having a conductive braiding layer soldered to the ground plane layer and a conductive inner core passing through the substrate and being soldered to the conductive patch, the method comprising adjusting the height of the conductive patch above the top surface of the substrate to achieve a good performance of the microstrip antenna, selecting a thickness h0 and a relative dielectric constant $\epsilon$ r of the dielectric substrate, and selecting other concerned parameters according to selected value h0, $\epsilon$ r and the height of the conductive patch above the top surface of the substrate.

4. A method for making an antenna, comprising the steps of:

providing a substrate with a selected thickness and a selected relative dielectric constant thereof;

providing a conductive patch with a height above a top surface of the substrate;

selecting a width of the conductive patch;

calculating an effective length of the conductive patch;

selecting a feed point location of a coaxial feeder cable on the patch; selecting a thickness h0 and a relative dielectric constant $\epsilon$ r of the dielectric substrate, and a height h1 and h2 of the first and second conductive patches above the top surface of the substrate and adjusting said height to achieve a required ratio/pattern of the antenna.

5. The method as claimed in claim 4, further including a step of providing a ground plane layer attached to a bottom surface of the substrate.

6. The method as claimed in claim 4, further including a step of providing a conductive post connected between the substrate and the conductive patch.

7. The method as claimed in claim 6, further including a step of adjusting a distance between the feed point and a joint location of said conductive post on said conductive patch.

* * * * *